US010415287B1

(12) United States Patent
Kunz

(10) Patent No.: US 10,415,287 B1
(45) Date of Patent: Sep. 17, 2019

(54) COUNTERBALANCE SYSTEM FOR TILT-IN WINDOW HAVING A SHIELDED BRAKE SHOE STRUCTURE

(71) Applicant: John Evans' Sons, Inc., Lansdale, PA (US)

(72) Inventor: John R. Kunz, Douglassville, PA (US)

(73) Assignee: John Evans' Sons, Inc., Lansdale, PA (US)

( * ) Notice: Subject to any disclaimer, the term of this patent is extended or adjusted under 35 U.S.C. 154(b) by 0 days.

(21) Appl. No.: 15/275,394

(22) Filed: Sep. 24, 2016

(51) Int. Cl.

| | |
|---|---|
| ***E05D 13/00*** | (2006.01) |
| ***E05D 15/22*** | (2006.01) |
| ***E06B 3/50*** | (2006.01) |
| ***E05F 5/00*** | (2017.01) |

(52) U.S. Cl.
CPC ..... *E05D 13/1276* (2013.01); *E05D 15/22* (2013.01); *E05F 5/003* (2013.01); *E06B 3/5063* (2013.01); *E05Y 2201/21* (2013.01); *E05Y 2201/482* (2013.01); *E05Y 2900/148* (2013.01)

(58) Field of Classification Search
CPC ..... E05D 13/1276; E05Y 2201/482
USPC ..... 49/445, 446, 181; 16/193, 197
See application file for complete search history.

(56) References Cited

U.S. PATENT DOCUMENTS

| | | | |
|---|---|---|---|
| 698,168 | A | 4/1902 | Barnum |
| 2,609,191 | A | 9/1952 | Foster |
| 2,609,193 | A | 9/1952 | Foster |
| 2,622,267 | A | 12/1952 | Peremi |
| 2,851,721 | A | 9/1958 | Decker et al. |
| 3,150,420 | A | 9/1964 | Brenner |
| 3,184,784 | A | 5/1965 | Peters |
| 3,434,236 | A | 3/1969 | Weidner et al. |
| 3,475,865 | A | 11/1969 | Ames |
| 3,529,381 | A | 9/1970 | Grossman |
| 3,820,193 | A | 6/1974 | Foster |
| 3,844,066 | A | 10/1974 | Nobes |
| 3,869,754 | A | 3/1975 | Foster |
| 3,992,751 | A | 11/1976 | Foster et al. |
| 4,028,849 | A | 6/1977 | Anderson |
| 4,079,549 | A | 3/1978 | Wood |
| 4,190,930 | A | 3/1980 | Prosser |
| 4,227,345 | A | 10/1980 | Durham, Jr. |
| 4,446,654 | A | 5/1984 | Schoolman et al. |

(Continued)

FOREIGN PATENT DOCUMENTS

| | | | |
|---|---|---|---|
| GB | 2278626 | A | 12/1994 |

*Primary Examiner* — Marcus Menezes
(74) *Attorney, Agent, or Firm* — LaMorte & Associates P.C.

(57) ABSTRACT

A counterbalance system for a window sash that engages a guide track in a vinyl tilt-in window. At least one ribbon spring coil is used to create the counterbalance force. The ribbon spring coils are held in a brake shoe chassis that travels within the guide track of the window. A first protective barrier is attached to the brake shoe chassis. The first protective barrier travels externally of the guide track and shields the slot opening adjacent the spring placement area. A second protective barrier is attached to the brake shoe chassis inside the guide track. The second protective barrier shields the spring placements areas from contamination within the guide track. A brake mechanism is also attached to the brake shoe chassis. The brake mechanism uses a cam to spread arms against the side walls of the guide track when the window sash is tilted. This provides contact against three inside walls of the guide track, therein creating a lock.

17 Claims, 8 Drawing Sheets

(56) References Cited

U.S. PATENT DOCUMENTS

| | | | |
|---|---|---|---|
| 7,703,175 | B2 | 4/2010 | Tuller |
| 8,181,396 | B1 | 5/2012 | Kunz |
| 8,640,383 | B1 | 2/2014 | Kunz |
| 9,133,656 | B2 | 9/2015 | Steen et al. |

COUNTERBALANCE SYSTEM FOR TILT-IN WINDOW HAVING A SHIELDED BRAKE SHOE STRUCTURE

BACKGROUND OF THE INVENTION

1. Field of the Invention

In general, the present invention relates to counterbalance systems for tilt-in windows that prevent open window sashes from moving under the force of their own weight. More particularly, the present invention system relates to the structure of both the brake shoe and the locking mechanism that locks the brake shoe in place when a sash of a tilt-in window is tilted from the window frame.

2. Description of the Prior Art

There are many types and styles of windows. One of the most common types of window is the double-hung window. Double-hung windows are the window of choice for most home construction applications. A double-hung window consists of an upper window sash and a lower window sash. Either the upper window sash or the lower window sash can be selectively opened and closed by a person sliding the sash up and down within the window frame.

The sash of a double-hung window has a weight that depends upon the materials used to make the window sash and the size of the window sash. Since the sashes of a double-hung window are free to move up and down within the frame of a window, some counterbalancing system must be used to prevent the window sashes from constantly moving to the bottom of the window frame under the force of their own weight.

A popular variation of the double-hung window is the tilt-in double-hung window. Tilt-in double-hung windows have sashes that can be selectively moved up and down. Additionally, the sashes can be selectively tilted into the home so that the exterior of the sashes can be cleaned from within the home.

Modern tilt-in double-hung windows are primarily manufactured in one of two ways. There are vinyl frame windows and wooden frame windows. In the window manufacturing industry, different types of counterbalance systems are traditionally used for vinyl frame windows and for wooden frame windows. The present invention is mainly concerned with the structure of vinyl frame windows. As such, the prior art concerning vinyl frame windows is herein addressed.

Vinyl frame tilt-in windows are typically manufactured with guide tracks along the inside of the window frame. Brake shoe assemblies, commonly known as "shoes" in the window industry, are placed in the guide tracks and ride up and down within the guide tracks. Each sash of the window has two tilt pins or tilt posts that extend into the shoes and cause the shoes to ride up and down in the guide tracks as the window sashes are opened or closed.

The shoes contain a brake mechanism that is activated by the tilt post of the window sash when the window sash is tilted inwardly away from the window frame. The shoe, therefore, locks the tilt post in place and prevents the base of the sash from moving up or down in the window frame once the sash is tilted open. Furthermore, the brake shoes are attached to spring coils inside the guide tracks of the window assembly. Spring coils are constant force springs, made from wound lengths of metal ribbon. The spring coils supply the counterbalance force needed to suspend the weight of the window sash.

Small tilt-in windows have small, relatively light window sashes. Such small sashes may only require a single spring coil on either side of the window sash to generate the required counterbalance forces. However, due to the space restrictions present in modern tilt-in window assemblies, larger springs cannot be used for heavier window sashes. Rather, multiple smaller spring coils are ganged together to provide the needed counterbalance force. A large tilt-in window sash may have up to eight spring coils to provide the needed counterbalance force.

In order to ensure that the spring coils wind and unwind in an organized and efficient manner, the spring coils are held within the structure of the brake shoe. As the brake shoe moves up and down in a window track, the springs rotate within the brake shoe, therein enabling the spring coils to extend and retract smoothly. Although the placement of springs in a housing of a brake shoe is commonplace, it does have its own set of problems. If multiple springs are placed in a brake shoe housing, the brake shoe housing has to be large enough to accommodate the springs. Brake shoes with large housings have large surface areas. As such, the brake shoes generate greater friction as they move up and down in the track of a window. Consequently, larger brake shoes are more likely to stick in place then are small brake shoes.

Another problem associated with larger brake shoes is that they hold multiple spring coils. As the springs extend, they apply an increasing torque to the brake shoe. The torque can cock the brake shoe housing and dramatically increase its friction in the track of a window. The torque can also cause the spring coils to shift within the brake shoe housing. This can cause the spring coils to foul as they rewind into the brake shoe housing.

Yet another problem associated with large brake shoe housings is that the large area intended to hold the spring coils has many openings to provide access to the springs. Unfortunately, these openings also enable dirt, dust and debris to enter the brake shoe housing. Often windows are installed in new construction and are exposed to large amounts of sawdust, drywall dust, and other common construction byproducts. Any such contamination that enters the track of a window will eventually settle onto the brake shoe. The brake shoe receives and accumulates the contamination until the presence of the contamination adversely affects the ability of the brake shoe to smoothly move or the springs to operate properly.

In the prior art, attempts have been made to minimize the size of housing of a brake shoe so it will not be able to collect much contamination. Such prior art is exemplified by U.S. Pat. No. 9,133,656 to Steen. However, such prior art designs do not protect the springs from contamination nor do they prevent the springs from shifting and binding as they wind and unwind. Prior art systems also have used covers that protect springs from contamination. Such prior art is exemplified by U.S. Pat. No 7,703,175 to Tuller. However, spring covers also do not prevent spring coils from shifting positions within the brake shoe as they wind and unwind.

A need therefore exists for an improved window counterbalance system having a brake shoe housing that is designed to minimize the adverse affects of contamination exposure and to prevent spring coils within the brake shoe housing from rotating into a cocked position under the forces of their own spring biases.

In the track of a traditional vinyl tilt-in window, there is a rear wall, two sidewalls and a slotted front wall. The slotted front wall provides access to the brake shoe and enables the window sash to remain connected to the brake shoe as the window opens and closes. Many brake shoes have brake mechanisms that are activated when the window sash is tilted inwardly. The brake mechanisms come in many styles. Typically, the brake mechanism will cause a section of the brake shoe to expand when the window sash is tilted. This causes the brake shoe to engage the two side walls of the window track. The engagement with the side walls creates enough friction to lock the brake shoe in place in the window track. Such prior art brake mechanisms are exemplified by U.S. Pat. No. 8,640,383 to Kunz.

Although the window track contains a large solid rear wall and two side walls that are much thinner, the braking mechanism only engages the thin side walls. This causes wear to the side walls. The brake shoe housing is biased against the thin side walls by the forces of the spring coils. As such, any wear on the thin side walls can create much larger friction forces against the brake shoe housing as the brake shoe housing slides along the thin side walls. The brake shoe has only minimal contact with the rear wall of the window track, even though the rear wall is the largest available surface in the window track.

A need therefore also exists for a brake shoe that contains a brake mechanism that engages the rear wall of a window track in addition to the two side walls. In this manner, braking forces can be greatly increased and the wear to the side walls can be minimized.

These needs are met by the present invention as described and claimed below.

SUMMARY OF THE INVENTION

The present invention is a counterbalance system for a window sash that engages a guide track in a vinyl tilt-in window. The guide track has two opposing side walls, a rear wall, and a front wall with a slot opening.

At least one ribbon spring coil is used to create the counterbalance force. Each ribbon spring coil has a free end. The ribbon spring coils are held in a brake shoe chassis. The brake shoe chassis has a first end and an opposite second end, wherein the brake shoe chassis travels within the guide track of the window.

Spring guides extend from the brake shoe chassis, wherein the spring guides define spring placement areas that retain the ribbon spring coils. A first protective barrier is also attached to the brake shoe chassis. The first protective barrier travels externally of the guide track, wherein the first protective barrier is coupled to the brake shoe chassis by a support that extends through the slot opening of the guide track. The first protective barrier shields the slot opening adjacent the spring placement area, therein inhibiting contamination from entering the spring placement area through the slot opening.

A second protective barrier is attached to the brake shoe chassis inside the guide track. The second protective barrier shields the spring placements areas from contamination within the guide track.

A brake mechanism is also attached to the brake shoe chassis. The brake mechanism uses a cam to spread arms against the side walls of the guide track when the window sash is tilted. In addition, the cam itself moves laterally in the guide track to contact the rear wall of the guide track. This provides contact against three inside walls of the guide track, therein ensuring a secure lock.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE INVENTION

The features of the present invention counterbalance system can be incorporated into many window designs. However, the illustrations provided only show one exemplary embodiment of the counterbalance system for the purpose of description. The embodiment illustrated is selected in order to set forth one of the best modes contemplated for the invention. The illustrated embodiment, however, is merely exemplary and should not be considered a limitation when interpreting the scope of the claims.

Figure 1:
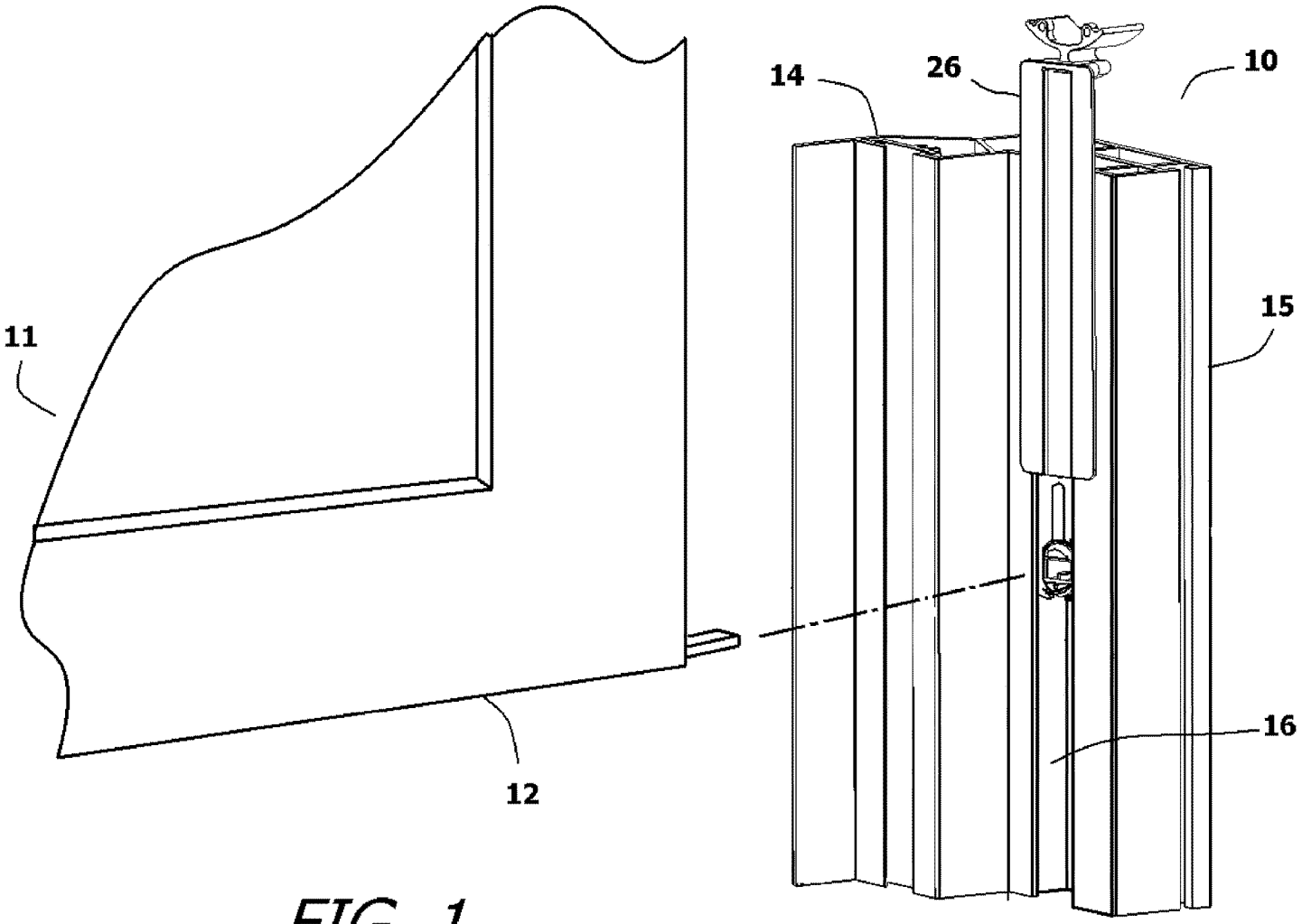
FIG. 1 is fragmented view showing an exemplary embodiment of a counterbalance system in a guide track of a tilt-in window.
Figure 2:
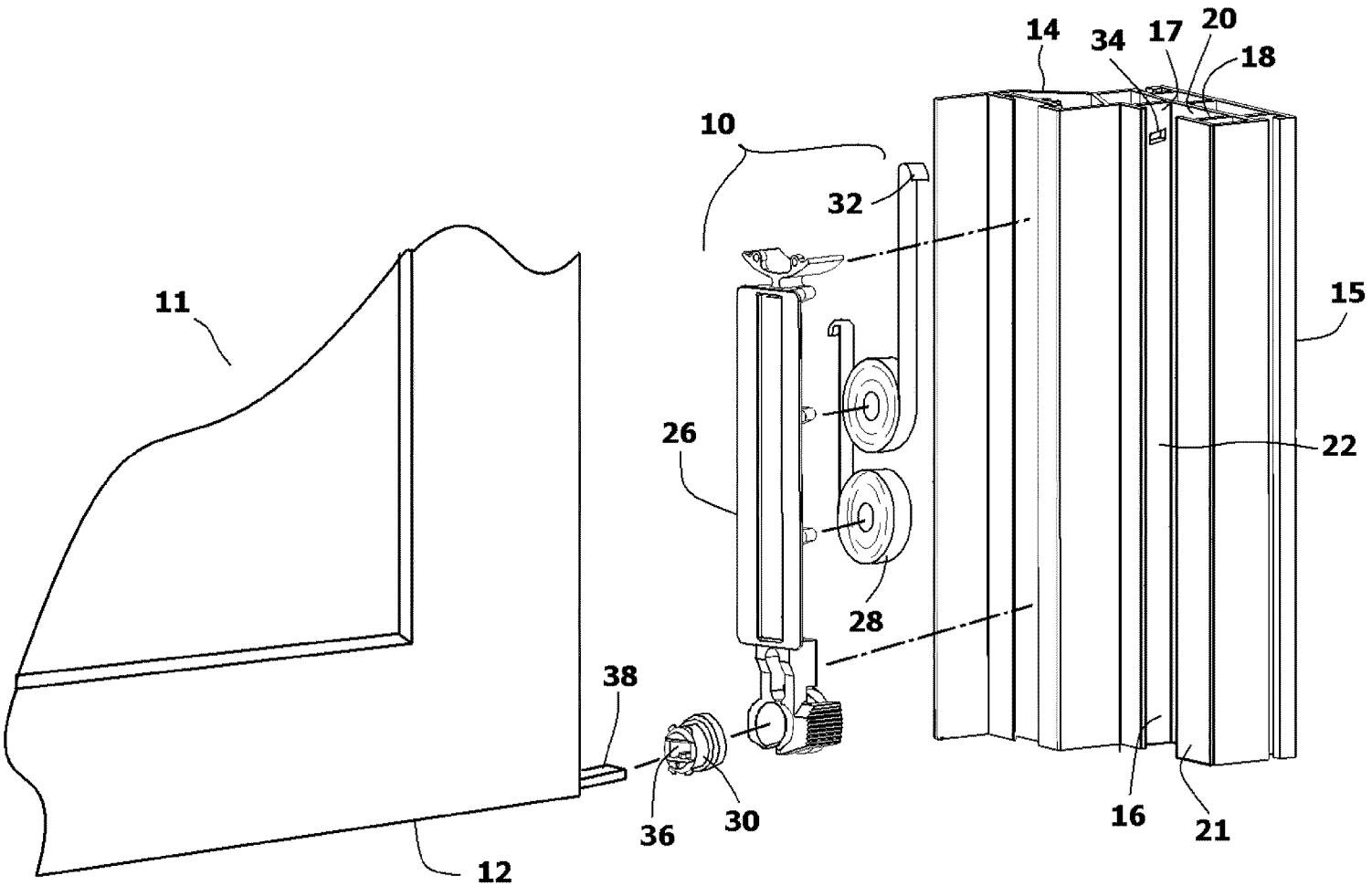
FIG. 2 is an exploded perspective view of the primary components of the counterbalance system shown in FIG. 1.

Referring to FIG. 1, in conjunction with FIG. 2, a counterbalance system 10 is shown that is used to counterbalance a window sash 12 contained within a vinyl tilt-in window assembly 11. The tilt-in window assembly 11 has a molded window frame 14 that includes vertical frame elements 15. A guide track 16 is molded into the vertical frame elements 15. The guide track 16 has two opposing side walls 17, 18, a rear wall 20 and a slotted front wall 21. The guide track 16 is accessed through an open slot 22 on the slotted front wall 21.

A brake shoe assembly is provided. The brake shoe assembly includes a brake shoe chassis 26, ribbon spring coils 28 and an action cam 30. The brake shoe chassis 26 is a unistructurally molded piece that receives and retains the ribbon spring coils 28 and the action cam 30. As will be explained, the brake shoe chassis 26 retains the ribbon spring coils 28 and the action cam 30 inside the guide track 16, while protecting these elements from contamination.

Each of the ribbon spring coils 28 has a free end 32 that is anchored to one of the side walls 17, 18 within the guide track 16. This can be accomplished using a mechanical fastener or anchor mount. However, in the shown embodiment, the free ends 32 of the ribbon spring coils 28 have hook terminations that are used to engage mounting slots 34 formed in the side walls 17, 18 of the guide track 16.

The action cam 30 has a tilt post receptacle 36. The tilt post receptacle 36 is sized to receive a tilt post 38 that extends from the window sash 12. The tilt post 38 on the window sash 12 rotates when the window sash 12 is tilted out of the window frame 14. As such, it will be understood that the tilt post 38 causes the action cam 30 to rotate when the window sash 12 is tilted out of the window frame 14.

Figure 3:
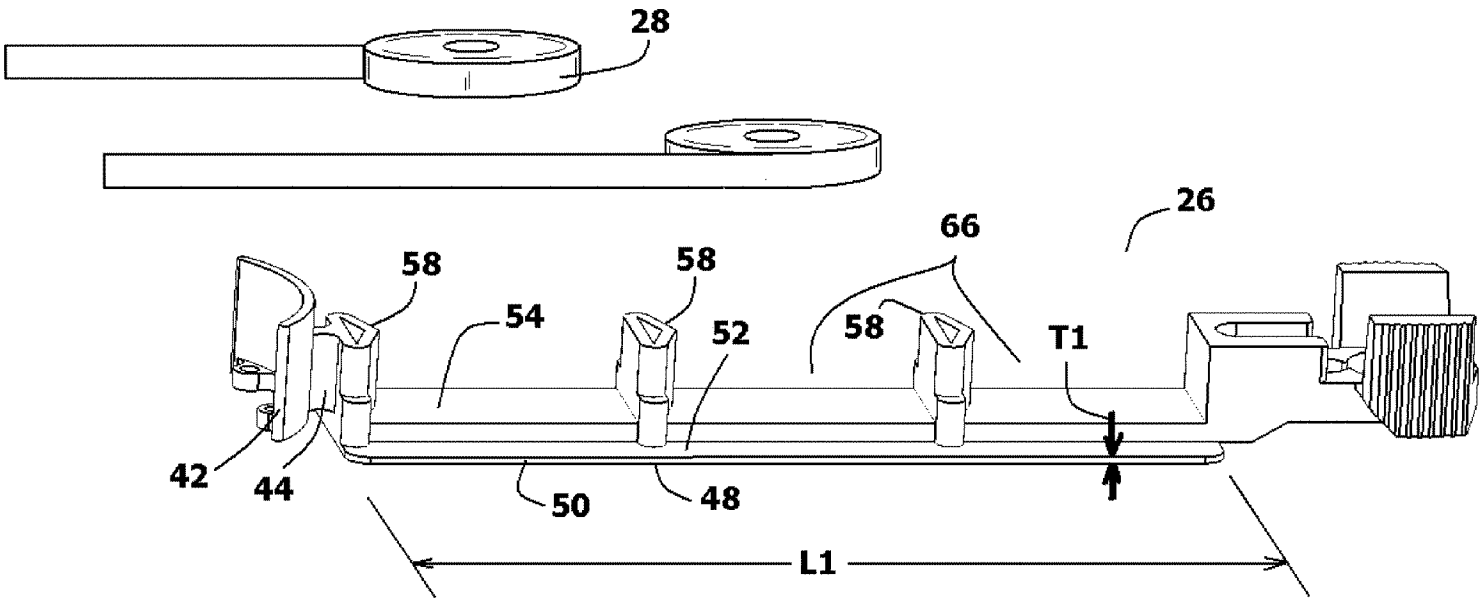
FIG. 3 shows a perspective view of the brake shoe chassis shown in conjunction with ribbon spring coils.
Figure 4:
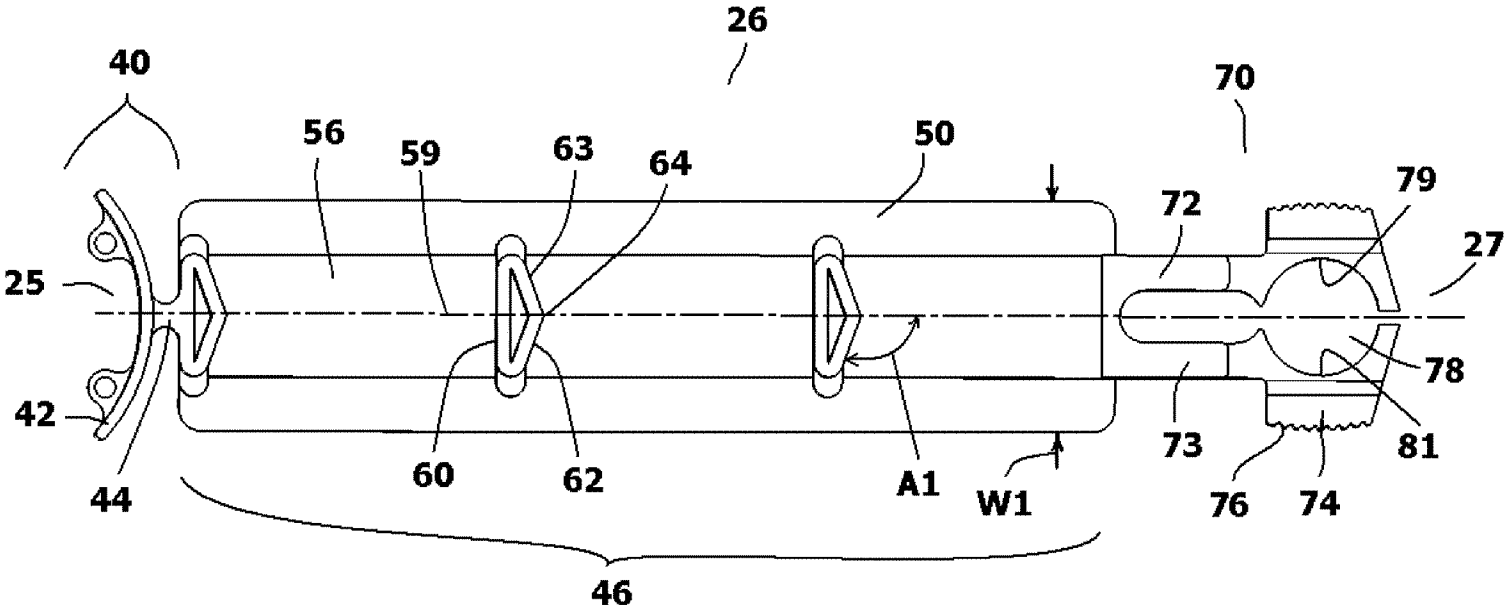
FIG. 4 shows a top view of the brake shoe chassis.

Referring to FIG. 3 and FIG. 4, in conjunction with FIG. 2, it can be seen that the brake shoe chassis 26 has at first end 25 and a second end 27. In between the first end 25 and the second end 27 are three sections. In the preferred embodiment, the three sections are integrally molded together as a single unit. However, in an alternate embodiment, one or more of the sections can be separately manufactured and added into the brake shoe chassis 26 as an assembly.

The first section of the brake shoe chassis 26 extends from the first end 25. The first section is the vertical barrier section 40. The vertical barrier section 40 contains a wiping head barrier 42. The wiping head barrier 42 is a curved surface of thin plastic that curves away from the remainder of the brake shoe chassis 26. The width of the wiping head barrier 42 is slightly wider than the distance between the side walls 17, 18 of the guide track 16. The wiping head barrier 42 is supported by a thin neck 44. The thin neck 44 enables the wiping head barrier 42 to bend slightly from side-to-side. Furthermore, the plastic of the wiping head barrier 42 on either side of the neck 44 is thin enough to enable the wiping head barrier 42 to slightly deform if contacted with sufficient force.

The second section of the brake shoe chassis 26 is a spring retention section 46. The spring retention section 46 receives, retains and protects the ribbon spring coils 28. Most of the brake shoe chassis 26 fits within the guide track 16 and moves within the confines of the guide track 16. The exception is a thin protective barrier 50 that travels outside the guide track 16. The thin protective barrier 50 is connected to the brake shoe chassis 26 by a support rail 54 that extends through the open slot 22 of the guide track 16. The protective barrier 50 has a length L1 and width W1 that depend upon the diameters of the ribbon spring coils 28 being retained. The length L1 and the width W1 of the protective barrier 50 are large enough so that the area of the protective barrier 50 is larger than the combined profile area of the ribbon spring coils 28 being used. In this manner, the protective barrier 50 is capable of covering all of the springs 28 in one direction.

The protective barrier 50 is very thin, having a preferred thickness T1 of between 0.020 inches and 0.060 inches. The periphery of the protective barrier 50 extends in a common plane that is outside the guide track 16 but parallel to the slotted front wall 21 of the guide track 16. The protective barrier 50 has a first side 48 and an opposite second side 52. The support rail 54 extends along the center of the second side 52 of the protective barrier 50. The support rail 54 has a top surface 56 that is parallel to the peripheral common plane of the protective barrier 50.

A plurality of spring guides 58 extend away from the top surface 56 of the support rail 54 at a perpendicular. The spring guides 58 are linearly aligned along the midline 59 of the support rail 54. Each of the spring guides 58 has a triangular profile when viewed at a perpendicular to the top surface 56 of the support rail 54. Each spring guide 58 has a long surface 60 and two angled short surfaces 62, 63 that form the triangular shape. The two short surfaces 62, 63 are offset by an angle A1 from the midline 59, wherein the angle A1 is between forty-five degrees and seventy-five degrees. An offset angle of approximately seventy degrees is preferred. The two angled short surfaces 62, 63 meet at a salient edge 64. The salient edges 64 of all the spring guides 58 are linearly aligned along the midline 59 so as to be aligned along the center of the support rail 54.

The spring guides 58 are all aligned in the same direction with the long surface 60 facing the barrier section 40. A spring placement area 66 exists between each set of the spring guides 58. The spring placement area 66 is defined by the underlying support rail 54, the long surface 60 of a first spring guide 58 and the angled short surfaces 62, 63 of an adjacent spring guide. Each spring placement area 66 is otherwise open and unbounded. As such, there is little structure upon which contamination can accumulate. In the shown embodiment, there are three spring guides 58 that define three spring placement areas 66. It will be understood that in alternate embodiments two spring guides can define a single spring placement area or multiple spring guides can define multiple spring placement areas.

The third section of the brake shoe chassis 26 is a brake section 70. The brake section 70 includes two long arms 72, 73 that terminate with contact heads 74. The contact heads 74 have textured exterior surfaces 76 that each has a high coefficient of friction. A cylindrical cam opening 78 is defined between the two long arms 72, 73. As such, the cam opening 78 is defined in part by a curved interior surface 79 on the first long arm 72 and a curved interior surface 81 on the second long arm 73.

Figure 5:
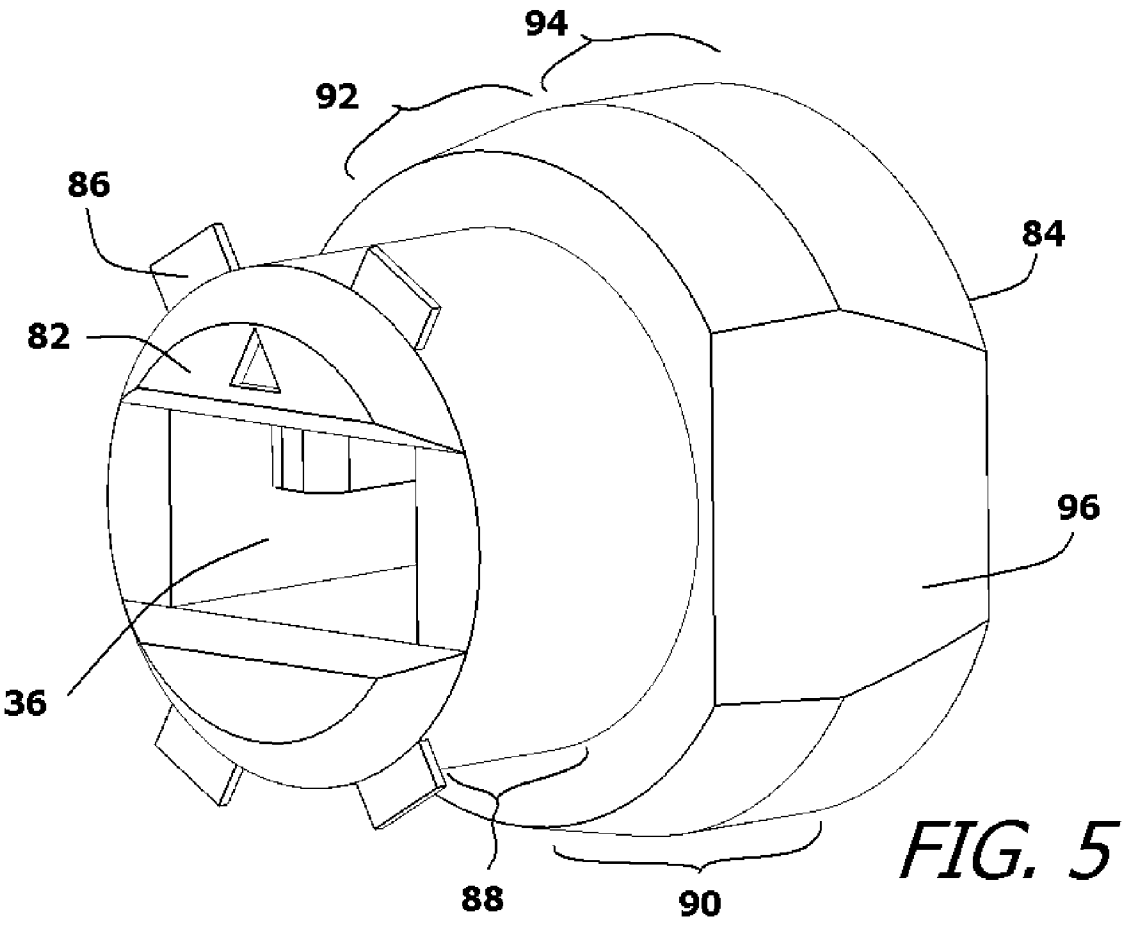
FIG. 5 shows a perspective view of the action cam.
Figure 7:
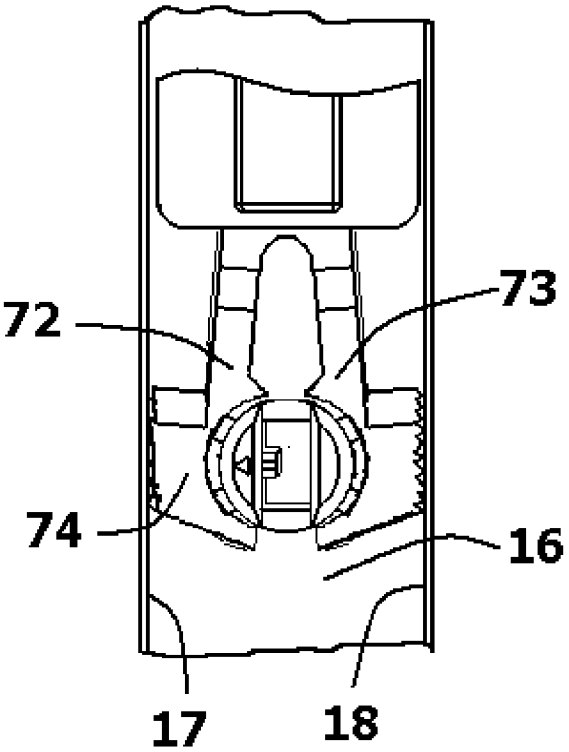
FIG. 7 shows a front view of the brake mechanism in a locked condition.
Figure 6:
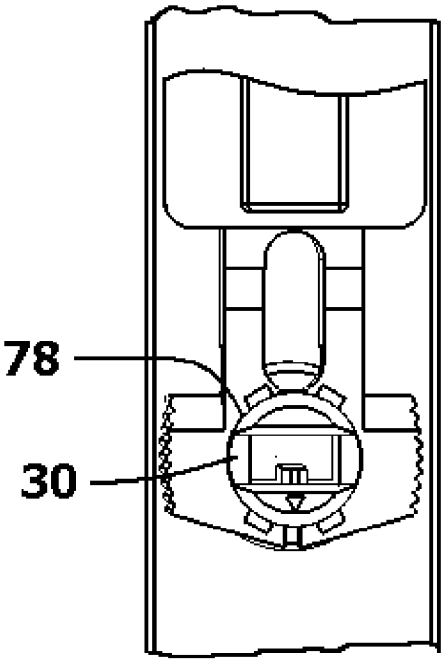
FIG. 6 shows a front view of the brake mechanism in an unlocked condition.

Referring to FIG. 5, FIG. 6, and FIG. 7, in conjunction with FIG. 2 and FIG. 4, it can be seen that the action cam 30 has a first end 82 and an opposite second end 84. The first end 82 contains the tilt post receptacle 36 for receiving the tilt-post 38 of the window sash 12. The first end 82 also includes flange stops 86 that prevent the action cam 30 from being over-inserted into the cam opening 78. The action cam 30 has a cylindrical section 88 that extends away from the first end 82. The cylindrical section 88 transitions into an enlarged head 90. The enlarged head 90 has a beveled section 92 that leads into a second cylindrical section 94. The second cylindrical section 94 terminates at the second end 84 of the action cam 30. The second end 84 is flat and may be textured to increase its coefficient of friction.

Two angled cutaway flats 96 are formed across the beveled section 92 and the second cylindrical section 94 on opposite sides of the action cam 30. The beveled section 92 has a first diameter. The distance between the cutaway flats 96 is smaller than the diameter of the beveled section 92.

The action cam 30 is received within the cam opening 78 in the brake section 70 of the brake shoe chassis 26. The action cam 30 is rotated within the cam opening 78 when the window sash 12 is tilted out of the window frame 14. When the window sash 12 is flush in the window frame 14, the action cam 30 is positioned so the cutaway flats 96 on the action cam 30 face the curved interior surfaces 79, 81 of the long arms 72, 73. In this position, the action cam 30 does not displace the long arms 72, 73 because the action cam 30 fits within the dimensions of the cam opening 78. See FIG. 6. However, when the window sash 12 is tilted, the tilt post 38 turns the action cam 30 within the cam opening 78. The beveled section 92 of the action cam 30 is turned against the curved interior surfaces 79, 81 of the long arms 72, 73. The beveled section is wider than the distance between the long arms 72, 73. As such, the action cam 30 spreads the long arms 72, 73. The long arms 72, 73 spread and cause the contact heads 74 to contact the side walls 17, 18 of the guide track 16. This locks the brake shoe chassis 26 in place.

Figure 9:
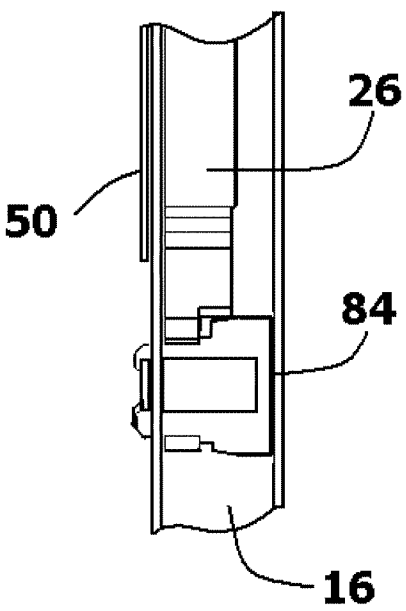
FIG. 9 shows a cross-section of the brake mechanism in a locked condition.
Figure 8:
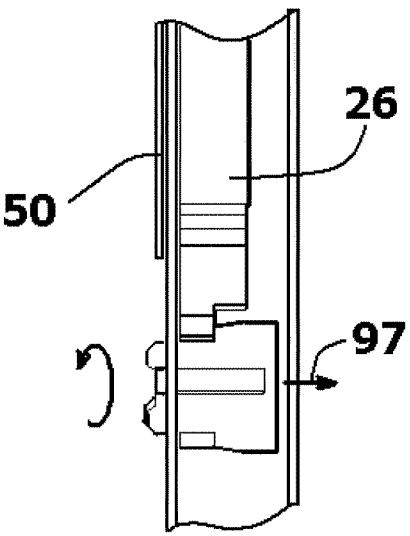
FIG. 8 shows a cross-section of the brake mechanism in an unlocked condition.

Furthermore, referring to FIG. 8 and FIG. 9 in conjunction with FIG. 5, it can be seen that due to the beveled shape of the beveled section 92, the action cam 30 is driven in the direction of arrow 97 as it is turned. This moves the action cam 30 laterally, therein moving the second end 84 of the action cam 30 into an extended position. This contact also acts to lock the brake shoe chassis 26 in place.

Figure 10:
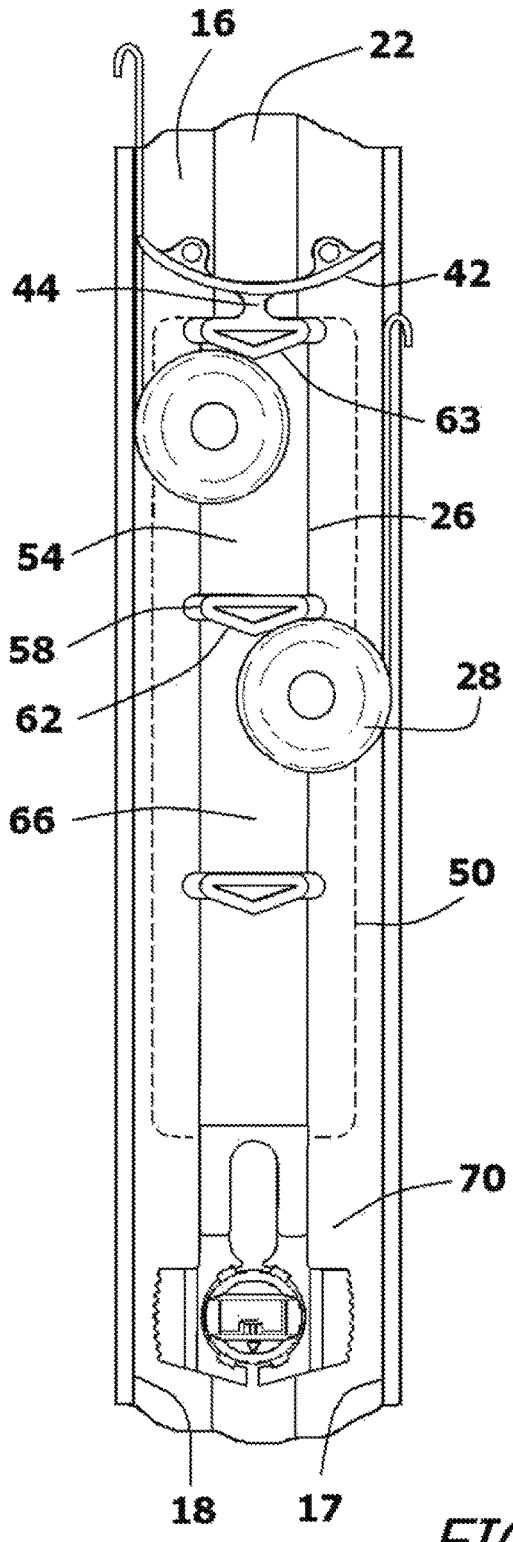
FIG. 10 shows the brake shoe assembly in the guide track of the window frame.

Referring to FIG. 10 in conjunction with FIG. 7 through FIG. 9, it can be seen that the brake shoe chassis 26 is engaged with the guide track 16. When engaged, the wiping head barrier 42, the support rail 54, the spring guides 58, the ribbon spring coils 28 and the brake section 70 are all positioned within the guide track 16. The protective barrier 50, however, remains outside the guide track 16. The wiping head barrier 42 contacts both of the side walls 17, 18 of the guide track 16. As such, the wiping head barrier 42 wipes the side walls 17, 18 free of debris as the brake shoe chassis 26 moves within the guide track 16. Furthermore, the wiping head barrier 42 acts as a physical barrier that prevents any sawdust, drywall dust or other construction contamination from reaching the ribbon spring coils 28 from above in the guide track 16. The thinness of the wiping head barrier 42 plus the thin neck 44 of the wiping head barrier 42, enable the wiping head barrier 42 to pivot and bend around any contacted obstruction, such as when the wiping head barrier 42 sweeps past one or more of the extended ribbon spring coils 28.

The protective barrier 50 shields the ribbon spring coils 28 from the side. Accordingly, no contamination can reach the ribbon spring coils 28 in the guide track 16 by passing laterally through the open slot 22 of the guide track 16. Furthermore, the protective barrier 50 prevents the ribbon spring coils 28 from being viewed through the open slot 22, which deters people from touching or tampering with the ribbon spring coils 28. Accordingly, the ribbon spring coils 28 are protected from above by the wiping head barrier 42 and from the side by the protective barrier 50. From below, the ribbon spring coils 28 are protected by the presence of the brake section 70.

In FIG. 10, it can be seen that the ribbon spring coils 28 are set in the spring placement areas 66 between the spring guides 58. As the ribbon spring coils 28 extend, the force of each ribbon spring coil 28 biases the ribbon spring coil 28 against one of the angled short surfaces 62, 63 of the spring guides 58. The angle of the short surfaces 62, 63 biases the ribbon spring coil 28 against the side walls 17, 18 of the guide track 16 upon which the ribbon spring coil 28 unwinds. This keeps each ribbon spring coil 28 at a tangent to the side wall 17, 18 of the guide track 16 and in its optimal position to wind and unwind without binding. The angled short surfaces 62, 63 of the spring guides 58 further ensure that the tangent positioning of the ribbon spring coils 28 is maintained even as the ribbon spring coils 28 change in diameter with winding and unwinding.

When the window sash 12 is not tilted, the action cam 30 does not expand the long arms 72, 73 of the brake section 70. Furthermore, the second end 84 of the action cam 30 is not biased against the rear wall 20 of the guide track 16. Accordingly, the brake section 70 does not engage the guide track 16 and the overall brake shoe assembly 24 is free to move in the guide track 16. The window sash 12 is therefore free to move up and down in the window frame 14.

When the window sash 12 is tilted in the window frame 14, the action cam 30 rotates. This spreads the long arms 72, 73 in the brake section 70 and causes the textured, high-friction, surfaces of the long arms 72, 73 to press against the side walls 17, 18 of the guide track 16, as shown in FIG. 7. Simultaneously, the action cam 30 moves laterally and the second end 84 of the action cam 30 is biased against the rear wall 20 of the guide track 16, as shown in FIG. 9. As a result, there is contact with the two side walls 17, 18 and the rear wall 20 of the guide track 16. This firmly locks the brake shoe chassis 26 in place and prevents any movement of the brake shoe chassis 26 in the guide track 16. Furthermore, by spreading the contact against three surfaces, less wear occurs on any of the surfaces.

It will be understood that the embodiment of the present invention counterbalance system that is described and illustrated herein is merely exemplary and a person skilled in the art can make many variations to the embodiment shown without departing from the scope of the present invention. All such variations, modifications, and alternate embodiments are intended to be included within the scope of the present invention as defined by the claims.

What is claimed is:

1. A counterbalance system for a window sash that engages a guide track, wherein said guide track has two opposing side walls, a rear wall and a front wall with a slot opening, said system comprising:

a ribbon spring coil having a free end;

a molded shoe chassis that travels within said guide track, said shoe chassis including a wiping head barrier supported on a flexible neck that can bend within said guide track, wherein said wiping head barrier is a curved segment of plastic with opposing ends that are biased toward said two opposing side walls within said guide track, therein contacting said two opposing side walls and inhibiting contamination from passing said wiping head barrier within said guide track;

spring guides that extend from said shoe chassis, wherein said spring guides define a spring placement area between said spring guides in which said ribbon spring coil rests; and a protective barrier that travels external of said guide track, wherein said protective barrier is coupled to said shoe chassis by a support that extends through said slot opening of said guide track, wherein said protective barrier shields said slot opening adjacent said spring placement area, therein inhibiting contamination from entering said spring placement area through said slot opening.

2. The counterbalance system according to claim 1, wherein said protective barrier has a thickness of less than 0.06 inches.

3. The counterbalance system according to claim 1, wherein said shoe chassis, said spring guides, said support and said protective barrier are integrally molded as a single unit.

4. The counterbalance system according to claim 1, wherein said free end of said ribbon spring coil is mounted to one of said side walls of said guide track.

5. The counterbalance system according to claim 4, wherein said free end of said ribbon spring coil terminates with a hook configuration that engages a mounting slot formed in at least one of said side walls of said guide track.

6. The counterbalance system according to claim 1, wherein said spring guides include a first spring guide and a second spring guide that are linearly aligned along a common midline, wherein said first spring guide is closest to said wiping head barrier, wherein said first spring guide has two surfaces that are disposed at acute angles relative said midline and that meet at a point on said midline facing said spring placement area.

7. The counterbalance system according to claim 1, further including a brake mechanism.

8. The counterbalance system according to claim 7, wherein said brake mechanism includes two arm elements and a cam that is disposed between said arm elements, wherein said cam spreads said arm elements when rotated relative said arm elements.

9. The counterbalance system according to claim 8, wherein said arm elements are integrally molded as part of said shoe chassis.

10. The counterbalance system according to claim 8, wherein said cam moves laterally and extends out of said arm elements when rotated relative said arm elements.

11. A counterbalance system for a window sash that engages a guide track, wherein said guide track has two opposing side walls, a rear wall and a front wall with a slot opening, said system comprising:

a ribbon spring coil having a free end;

a shoe chassis having a first end, an opposite second end and a midline that bisects said shoe chassis between said first end and said second end, wherein shoe chassis travels within said guide track;

a first spring guide and a second spring guide that extend from said shoe chassis, wherein said first spring guide and said second spring guide define a spring placement area therebetween in which said ribbon spring coil rests, wherein said first spring guide and said second spring guide are linearly aligned along said midline, wherein said first spring guide is closest to said first end of said shoe chassis, and wherein said first spring guide has a triangular shape with a long surface and two angled short surfaces, wherein said two angled short surfaces are disposed at acute angles relative said midline and converge at a point on said midline facing said spring placement area.

12. The counterbalance system according to claim 11, further including a first protective barrier that travels external of said guide track, wherein said first protective barrier is coupled to said shoe chassis by a support that extends through said slot opening of said guide track, wherein said first protective barrier shields said slot opening adjacent said spring placement area, therein inhibiting contamination from entering said spring placement area through said slot opening.

13. The counterbalance system according to claim 12, further including a second protective barrier that inhibits contamination from entering said spring placement area past said first end of said shoe chassis.

14. The counterbalance system according to claim 13, wherein said shoe chassis, said first spring guide, said second spring guide, said support and said first protective barrier are integrally molded as a single unit.

15. The counterbalance system according to claim 11, further including a brake mechanism proximate said second end of said shoe chassis.

16. The counterbalance system according to claim 15, wherein said brake mechanism includes two arm elements and a cam that is disposed between said arm elements, wherein said cam spreads said arm elements when rotated relative said arm elements.

17. The counterbalance system according to claim 15, wherein said cam moves laterally and extends out of said arm elements when rotated relative said arm elements.

* * * * *